US012527373B2

(12) United States Patent
Cormack et al.

(10) Patent No.: US 12,527,373 B2
(45) Date of Patent: Jan. 20, 2026

(54) FASTENER HAVING A POCKET FOR AN EXTENDER

(71) Applicant: LULULEMON ATHLETICA CANADA INC., Vancouver (CA)

(72) Inventors: Elizabeth Cormack, Vancouver (CA); Kayleigh Jane Paull, Vancouver (CA)

(73) Assignee: LULULEMON ATHLETICA CANADA INC., Vancouver (CA)

( * ) Notice: Subject to any disclaimer, the term of this patent is extended or adjusted under 35 U.S.C. 154(b) by 28 days.

(21) Appl. No.: 18/568,880

(22) PCT Filed: Jun. 8, 2022

(86) PCT No.: PCT/CA2022/050910
§ 371 (c)(1),
(2) Date: Dec. 11, 2023

(87) PCT Pub. No.: WO2022/261750
PCT Pub. Date: Dec. 22, 2022

(65) Prior Publication Data

US 2024/0277091 A1 Aug. 22, 2024

Related U.S. Application Data

(60) Provisional application No. 63/212,304, filed on Jun. 18, 2021.

(51) Int. Cl.
*A41C 3/00* (2006.01)
*A41F 1/00* (2006.01)
*A44B 13/00* (2006.01)

(52) U.S. Cl.
CPC ..... *A41F 1/006* (2013.01); *A41C 3/0028* (2013.01); *A44B 13/0052* (2013.01)

(58) Field of Classification Search
CPC ..... A41C 3/0035; A41C 3/0028; A41F 1/006; Y10T 24/4091
See application file for complete search history.

(56) References Cited

U.S. PATENT DOCUMENTS 5,984,762 A * 11/1999 Tedeschi ..... A41F 15/007 2/243.1
7,086,925 B2 8/2006 Kaye et al.
(Continued)

FOREIGN PATENT DOCUMENTS

KR 20110062298 A 6/2011

OTHER PUBLICATIONS

International Searching Authority (ISA/CA), International Search Report and Written Opinion, mailed Aug. 12, 2022, for related International Patent Application No. PCT/CA2022/050910.
(Continued)

*Primary Examiner* — Jack W Lavinder
*Assistant Examiner* — Michael S Lee
(74) *Attorney, Agent, or Firm* — CONNEELY PC; Joseph Conneely

(57) ABSTRACT

Examples of a fastener with a pocket for an extender are disclosed. The fastener comprises a first part that comprises a male fastener element attached to its body and a second part that comprises a plurality of female fastener elements. The body of the second part comprises a top layer where the female fastener elements are attached and a bottom layer. The bottom layer has a slit forming a pocket entrance opening and a pocket space formed between the top layer and the bottom layer. The fastener further comprises an extender with an elongated body and a plurality of female fastener elements attached to the body. The extender is extendable from an end of the second part and is configured to be stored in the pocket space when not in use and to be
(Continued)

pulled out of the pocket space to extend the second part when in use.

9 Claims, 8 Drawing Sheets

(56) References Cited

U.S. PATENT DOCUMENTS

| | | | | |
|---|---|---|---|---|
| 10,609,965 | B2 * | 4/2020 | Lee | A41F 1/006 |
| 2006/0094334 | A1 | 5/2006 | Davis et al. | |
| 2011/0283489 | A1 * | 11/2011 | Yeung | A41F 1/006 24/442 |
| 2015/0101106 | A1 | 4/2015 | Anderson | |
| 2016/0037845 | A1 * | 2/2016 | Fung | A41C 3/0028 24/578.14 |
| 2016/0360812 | A1 | 12/2016 | Lockyer | |
| 2018/0303171 | A1 * | 10/2018 | Lee | A41C 3/12 |

OTHER PUBLICATIONS

European Patent Office (EPO), Extended European Search Report, mailed Feb. 20, 2025, for related European Patent Application No. 22823715.2.

* cited by examiner

FASTENER HAVING A POCKET FOR AN EXTENDER

This application claims priority from and the benefit of the filing date of U.S. Provisional Patent Application No. 63/212,304, filed Jun. 18, 2021, and the entire content of such application is incorporated herein by reference, and is a national phase entry of International Patent Application No. PCT/CA2022/050910, filed Jun. 8, 2022, and the entire content of such application is incorporated herein by reference.

FIELD

This application relates to the field of fasteners, and more specifically, to a garment fastener having an extender and a pocket for storing the extender.

BACKGROUND

Fasteners for garments are well-known and are used for bringing together and joining two pieces or portions of a garment. Typically, the fastener has a first unit having a male element (e.g., a hook) connected to a first piece of the garment and a second unit having a female element (e.g., an eye) connected to a second piece and configured to mate with the male element of the first unit to join the two pieces of the garment together. Commonly used fasteners have several rows of female elements arranged at varying distances along a longitudinal axis for altering the size and/or the fit of the garment. This provides a limited range of adjustment of the garment to the girth of a wearer. However, this limited range of adjustment may not be sufficient for a wearer who, for a variety of reasons, may require an expanded or extended adjustment range. For example, during pregnancy, the size of a wearer's waist or torso can increase necessitating that the wearer purchase one or more new garments of a more suitable size.

Several separate extenders for garment fasteners are known. These separate extenders typically have an elongated body that has a male element on one end and several rows of female elements arranged at varying distances on the opposite end. The wearer can use such known extenders to extend the size of a garment, such as for example, extending the size of a waistband of a pair of pants or the size of an underband of a bra. However, such separate extenders are not connected to or stored in the actual garment and so may be misplaced, lost, or otherwise unavailable when the wearer needs them.

SUMMARY OF THE APPLICATION

In one aspect, a fastener with a pocket for an extender is provided. The fastener may be used with a garment such as a bra or the like. The fastener comprises a first part having a body and a male fastener element attached to the body, a second part comprising an elongated body having a top layer, a bottom layer, and a plurality of female fastener elements attached to the body and an extender extendable from an end of the elongated body of the second part and comprising an elongated body having a plurality of female fastener elements attached to the elongated body of the extender. A slit is formed in the bottom layer of the second part of the fastener forming a pocket entrance opening into a pocket space formed between the top layer and the bottom layer of the second part. The extender is configured to be stored in the pocket space formed in the second part when not in use and to be pulled out of the pocket space to extend the second part when in use.

In addition to the aspects and embodiments described above, further aspects and embodiments will become apparent by reference to the drawings and study of the following detailed description.

BRIEF DESCRIPTION OF THE DRAWINGS

Throughout the drawings, reference numbers may be re-used to indicate correspondence between referenced elements. The drawings are provided to illustrate example embodiments described herein and are not intended to limit the scope of the application. Sizes and relative positions of elements in the drawings are not necessarily drawn to scale. For example, the shapes of various elements and angles may be not drawn to scale, and some of these elements may be arbitrarily enlarged and positioned to improve drawing legibility.

DETAILED DESCRIPTION

In the following description, details are set forth to provide an understanding of the application. In some instances, certain structures, techniques, and methods have not been described or shown in detail in order not to obscure the application.

Figure 1:
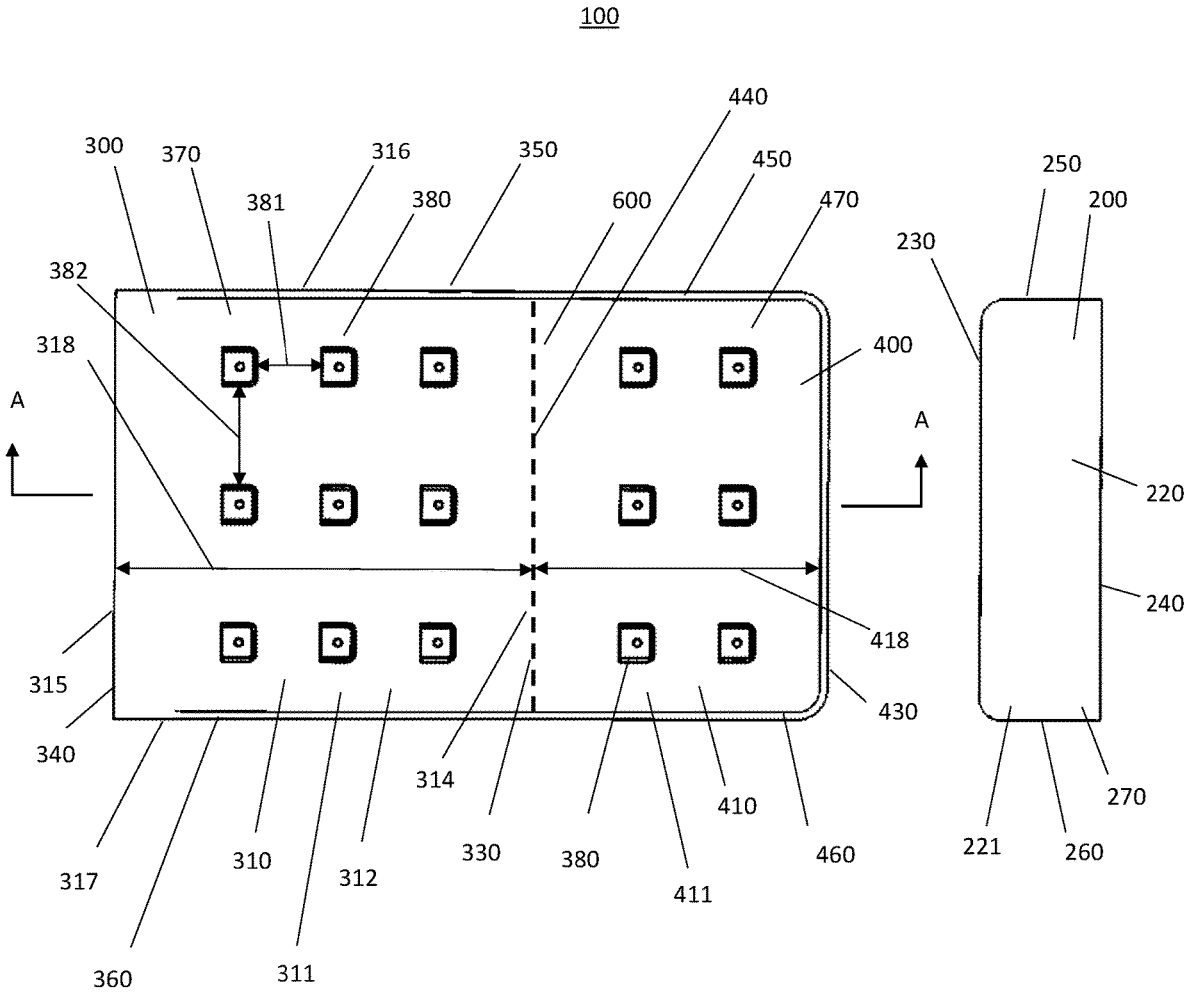
FIG. 1 is a top view illustrating an example fastener having a pocket for an extender.
Figure 2:
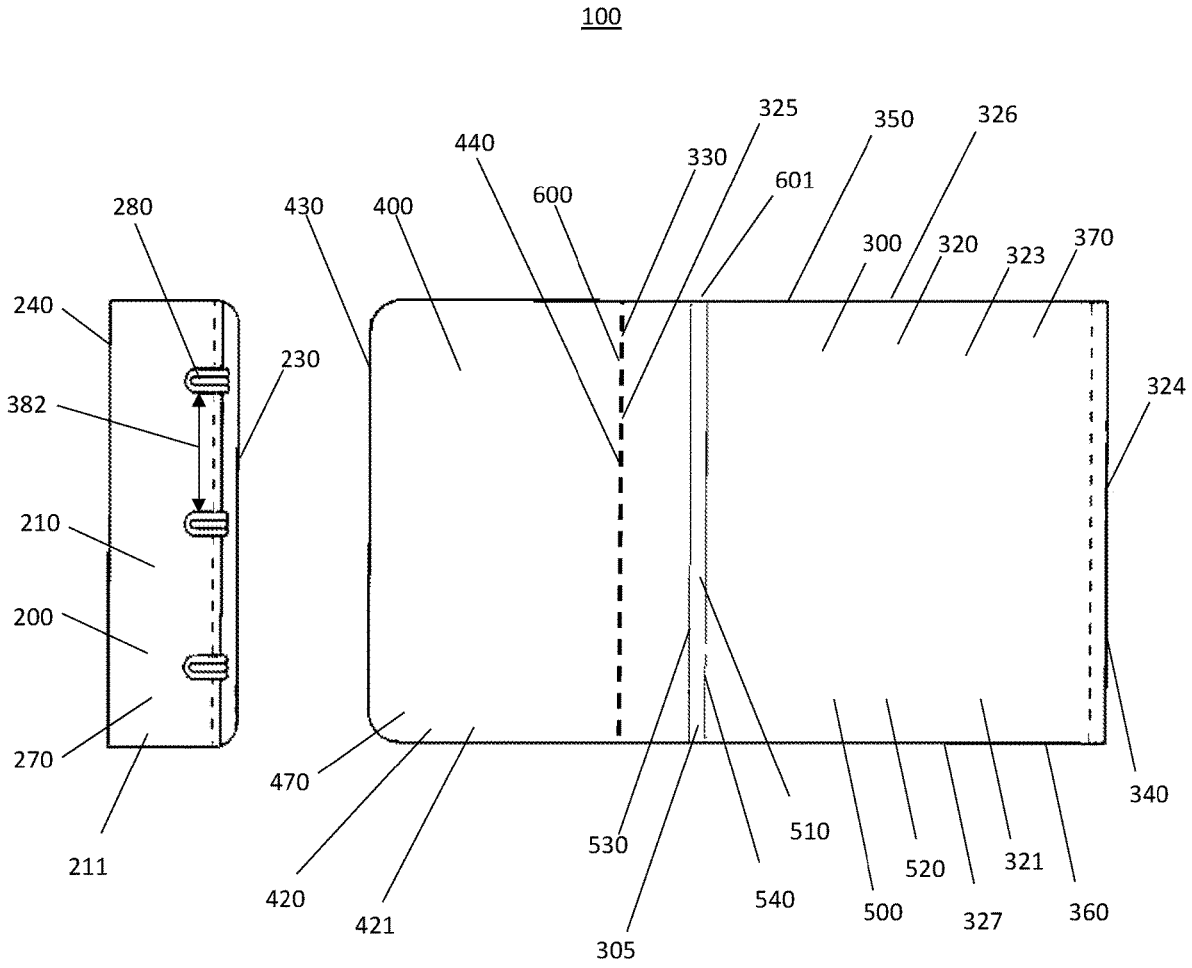
FIG. 2 is a bottom view thereof.
Figure 7:
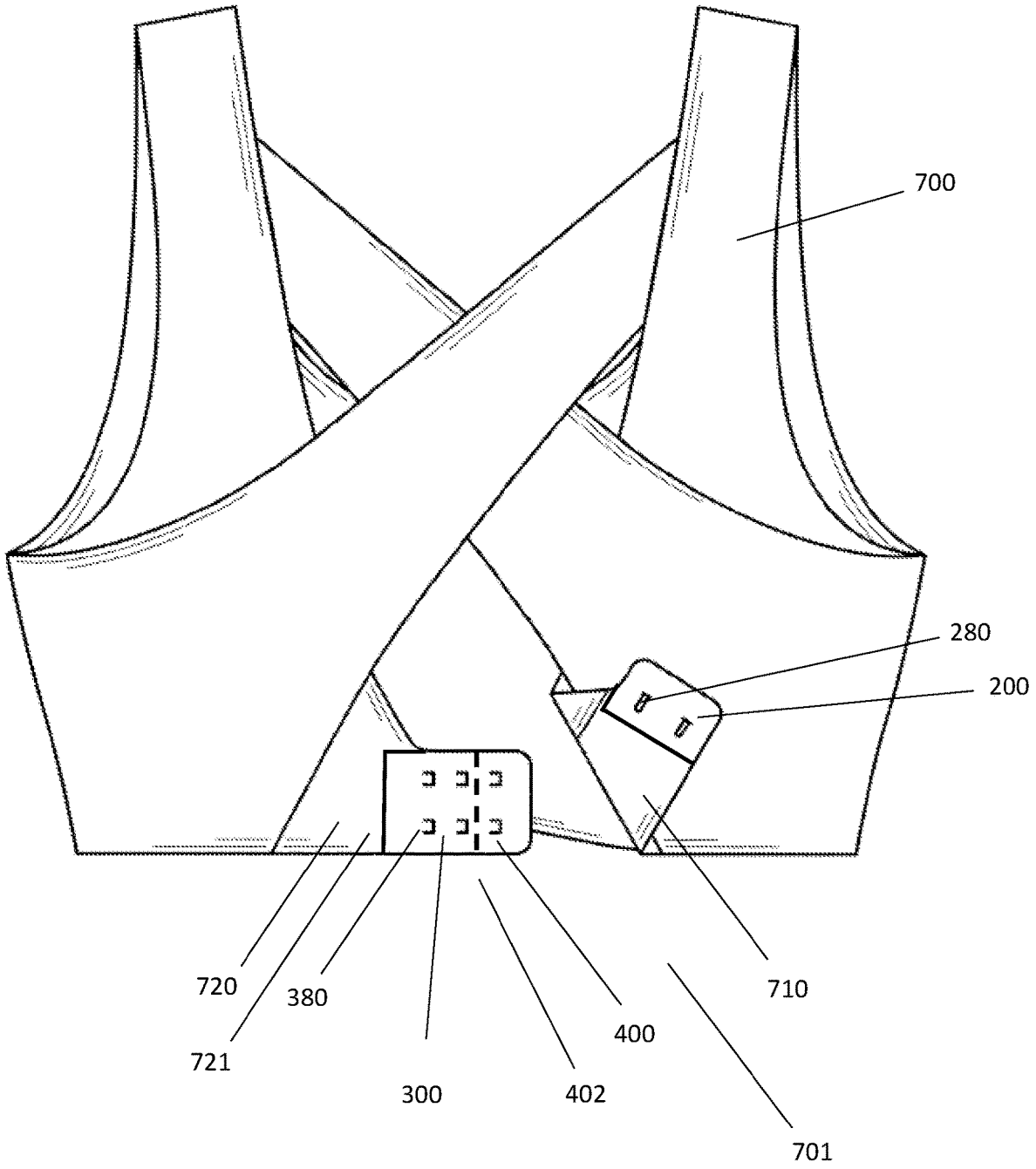
FIG. 7 is front view illustrating the fastener of FIG. 1 attached to the back portions of an example garment and showing the fastener and garment in an unfastened position.
Figure 8:
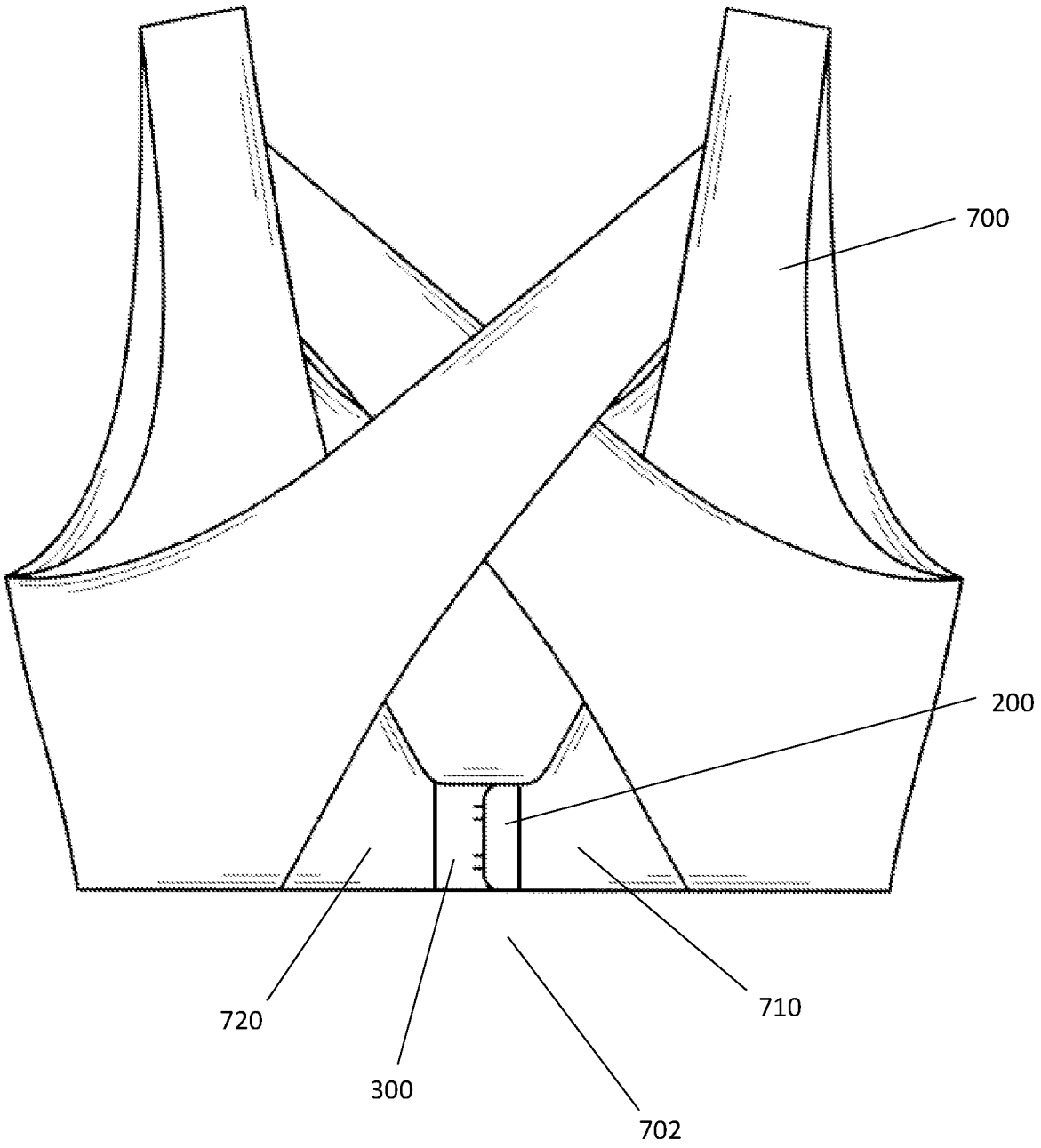
FIG. 8 is front view illustrating the fastener of FIG. 1 attached to the back portions of the example garment and showing the fastener and garment in a fastened position.

FIG. 1 is a top view illustrating an example fastener 100 having a pocket 500 for an extender 400. And, FIG. 2 is a bottom view thereof. The fastener 100 may be used to fasten portions 710, 720 of a garment 700 together. For example, the fastener 100 may be used as a back fastener for a bra 700 as shown in FIGS. 7-8 and as further described below.

The fastener 100 has a first part 200 and a second part 300. The first part 200 has a body 270 having an outer or front side 210, an inner or back side 220, an upper or top surface 211, a lower or bottom surface 221, a first or right end or edge 230, a second or left end or edge 240, a top or upper end or edge 250, and a bottom or lower end or edge 260. The first part 200 has at least one male element (or male fastener element) (e.g., a hook) 280 attached (e.g., connected, sewn, glued, bonded, coupled, joined, etc.) to the top surface 211 on the front side 210 of the body 270.

The second part 300 has an elongated body 370 having an outer or front side 310, an inner or back side 320, a first or right end or edge 330, a second or left end or edge 340, a top or upper end or edge 350, and a bottom or lower end or edge 360.

The elongated body 370 of the second part 300 also has an upper or top layer 311 and a lower or bottom layer 321. The top and bottom layers 311, 321 have respective upper or top surfaces 312, 322, lower or bottom surfaces 313, 323, first or right ends or edges 314, 324, second or left ends or edges 315, 325, top or upper ends or edges 316, 326, and bottom or lower ends or edges 317, 327. The first or right and second or left ends or edges 314, 325 of the top and bottom layers 311, 321 may be attached to form the first or right end or edge 330 of the second part 300; the second or left and first or right ends or edges 315, 324 of the top and bottom layers 311, 321 may be attached to form the second or left end or edge 340 of the second part 300; the top or upper ends or edges 316, 326 of the top and bottom layers 311, 321 may be attached to form the top or upper end or edge 350 of the second part 300; and, the bottom or lower ends or edges 317, 327 of the top and bottom layers 311, 321 may be attached to form the bottom or lower edge 360 of the second part 300.

The elongated body 370 of the second part 300 has a plurality of female elements (or female fastener elements) (e.g., eyes) 380 attached to the top surface 312 of the top layer 311 and arranged at predetermined distances 381 along a length 318 of the top layer 311. Each female element 380 is configured to be selectively engageable with the at least one male element 280 of the first part 200 to fasten the first and second parts 200, 300 together.

The fastener 100 has an extender 400 having an elongated body 470. The elongated body 470 of the extender 400 has an outer or front side 410, an inner or back side 420, an upper or top surface 411, a lower or bottom surface 421, a first or right end or edge 430, a second or left end or edge 440, a top or upper end or edge 450, and a bottom or lower end or edge 460. Similar to the second part 300, the elongated body 470 of the extender 400 has a plurality of female elements (e.g., eyes) 380 attached to the top surface 411 of the front side 410 of the elongated body 470 and arranged at predetermined distances 381 along a length 418 of the elongated body 470. The extender 400 is extendable from an end (or end face or edge) 330 of the elongated body 370 of the second part 300 and is configured to be stored in a pocket space 520 formed in the second part 300 when not in use and to be pulled out of the pocket space 520 to extend the second part 300 when in use. The pocket space 520 is described further below.

In one embodiment, the female elements 380 may be arranged in rows and columns on the top surface 312 of the top layer 311 of the second part 300. In the example embodiment of FIGS. 1-2, three rows and three columns (9 in total) of female elements 380 are shown on the second part 300. Similarly, the female elements 380 may be arranged in rows and columns on the top surface 411 of the extender 400. In the example embodiment of FIG. 1, three rows and two columns (6 in total) of female elements 380 are shown on the extender 400. Similarly, the male elements 280 may be arranged in rows and columns on the top surface 211 of the first part 200. In the example embodiment of FIG. 1, three rows and one column (3 in total) of male elements 280 are shown on the first part 200. In the example embodiment of FIGS. 7-8, two rows and two columns (4 in total) of female elements 380 are shown on the second part 300, two rows and one column (2 in total) of female elements 380 are shown on the extender 400, and two rows and one column (2 in total) of male elements 280 are shown on the first part 200. The number of elements 280, 380 used and their arrangement may vary with the size of the fastener, the size of the elements, the holding strength required, the type of the garment, etc.

In one embodiment, the horizontal spacing or distance 381 between female elements 380 on the second part 300 and on the extender 400 is 13 mm (or approximately 13 mm), the vertical spacing or distance 382 between female elements on the second part 300 and on the extender 400 is 18 mm (or approximately 18 mm), and the vertical spacing or distance 382 between male elements 280 on the first part 200 is 18 mm (or approximately 18 mm). The spacings 381, 382 between elements 280, 380 may vary with the size of the elements, the size of the fastener, the holding strength required, the type of the garment, etc.

The body 270 of the first part 200 may consist of one or more fabric panels. The top and bottom layers 311, 321 of the elongated body 370 of the second part 300 may be respective fabric panels. And, the elongated body 470 of the extender 400 may consist of one or more fabric panels. In one embodiment, the top layer 311 may be made from a combination of Nylon™ and Mircofiber Spandex™ and the bottom layer 321 may be made from a combination of Nylon™ and polypropylene. The bottom layer 321 may include a spacer fabric (e.g., polypropylene, etc.) to provide cushioning for the female elements 380 when the extender 400 is in the folded or retracted position 401 (as described further below). The male and female elements (e.g., hooks and eyes) 280, 380 may be made from plastic, metal, or the like.

Figure 3:
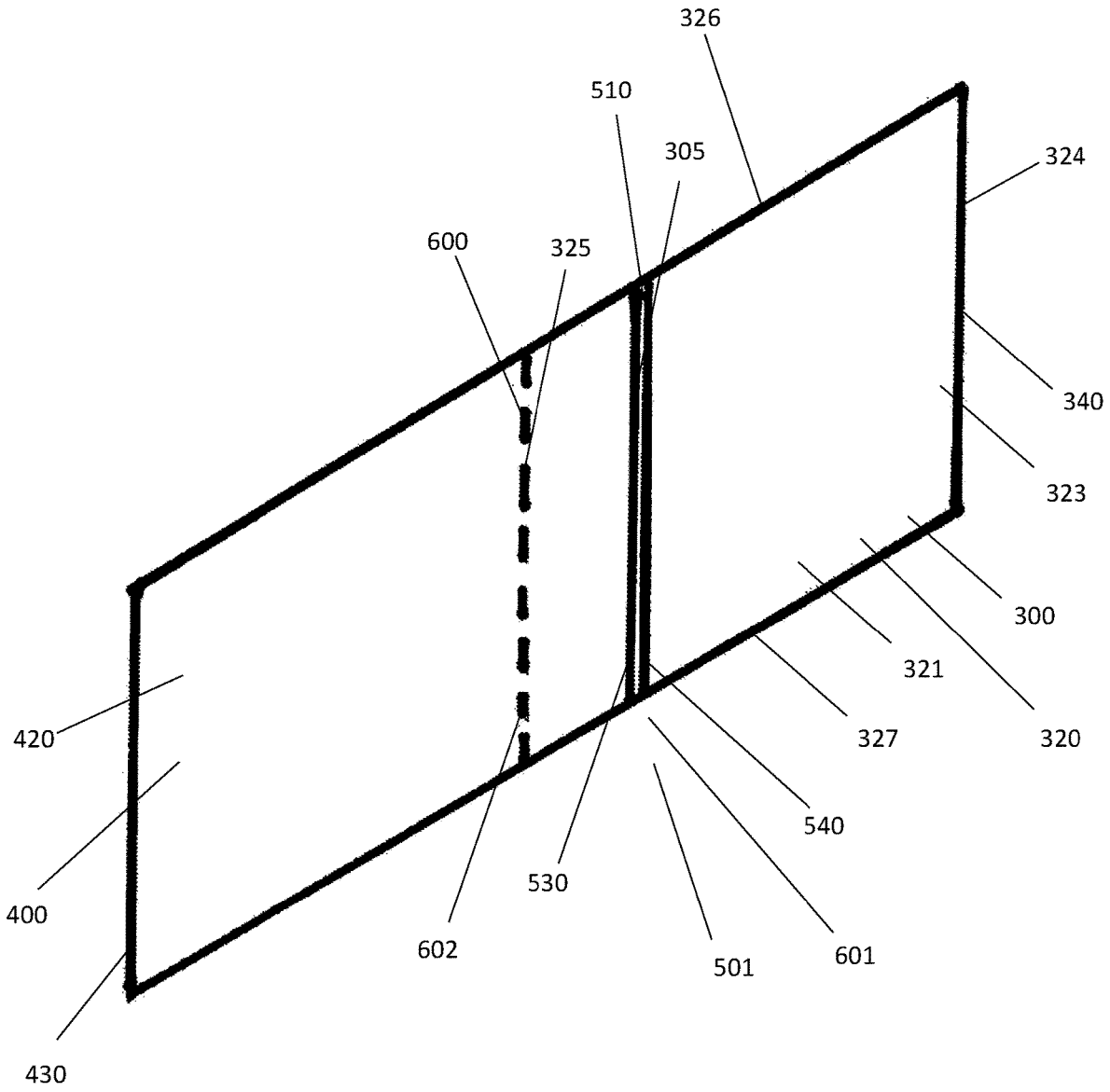
FIG. 3 is rear perspective view illustrating a second part of the fastener of FIG. 1 with a pocket entrance opening thereof shown in a closed position.
Figure 4:
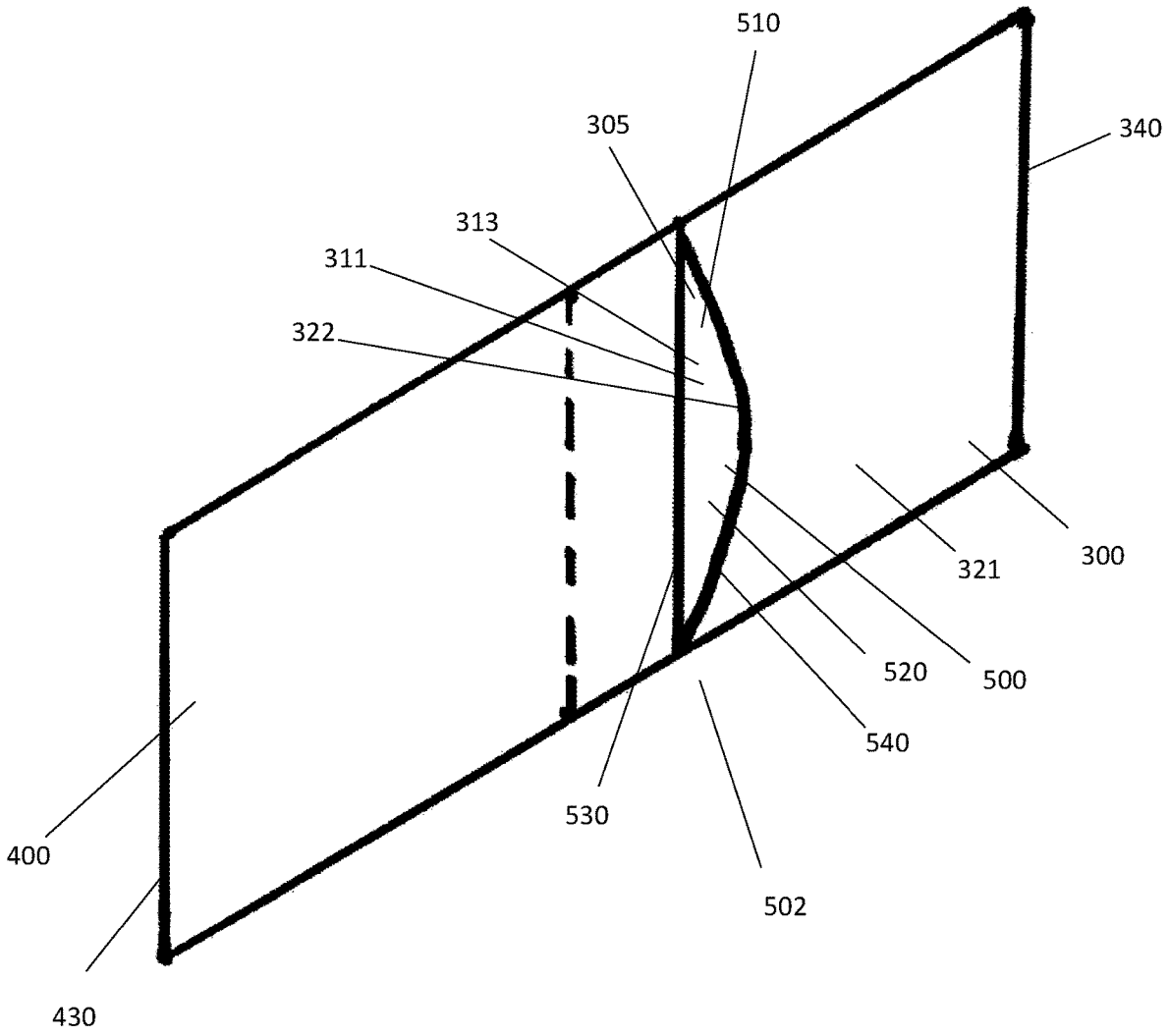
FIG. 4 is rear perspective view illustrating the second part of the fastener of FIG. 1 with the pocket entrance opening thereof shown in an opened position.

FIG. 3 is rear perspective view illustrating the second part 300 of the fastener 100 of FIG. 1 with a pocket entrance opening 510 thereof shown in a closed position 501. And, FIG. 4 is rear perspective view illustrating the second part 300 of the fastener 100 of FIG. 1 with the pocket entrance opening 510 thereof shown in an opened position 502.

The bottom layer 321 of the second part 300 may have a slit 305 made or formed therein extending transversely across (i.e., from proximate the top edge 326 to proximate the bottom edge 327) the bottom layer 321 forming a pocket entrance opening 510 into a pocket 500 having a pocket bag or space 520 formed between the top layer 311 and the bottom layer 321. The pocket entrance opening 510 has a first (or outward facing) pocket edge 530 and a second (or inward facing) pocket edge 540. The pocket entrance opening 510 and the pocket bag or space 520 are thus inward facing (i.e., the pocket bag or space 520 extends toward the left edge 340 of the fastener 100 from the pocket entrance opening 510). The pocket entrance opening 510 is sized to receive the extender 400 (e.g., the right edge 430 of the extender 400) for removably positioning within the pocket space 520. In one embodiment, the pocket entrance opening 510 is positioned at a location 601 along the bottom surface 323 of the bottom layer 321 of the fastener 100 located proximate (e.g., to the left in FIG. 5) of an example fold line 600 (see below) or left edge 325 of the bottom layer 321.

The second (or inward facing) pocket edge 540 is moveable from a closed position 501 (see FIG. 3) in which the pocket entrance opening 510 into the pocket space or bag 520 of the pocket 500 is collapsed or closed to an opened position 502 (see FIG. 4) in which the second (or inward facing) pocket edge 540 of the pocket space or bag 520 of the pocket 500 is expanded or opened 502, by a wearer inserting an item (e.g., an extender 400) or finger into the pocket 500 between the first (or outward facing) and the second (or inward facing) pocket edges 530, 540 and pulling or stretching the second (or inward facing) pocket edge 540 away from the first (or outward facing) pocket edge 530. In the opened position 502, at least a portion of the top surface 322 of the bottom layer 321 proximate the second (or inward facing) pocket edge 540 is separated from the bottom surface 313 of the top layer 311 expanding the pocket entrance opening 510 through which items (e.g., the extender 400) may be inserted into the pocket space or bag 520 of the pocket 500.

The second (or inward facing) pocket edge 540 is moveable from the opened position 502 in which the pocket entrance opening 510 is expanded or opened 502 to the closed position 501 in which the pocket entrance opening 510 is collapsed or closed 501, by a wearer removing an item (e.g., the extender 400) or finger from the pocket space or bag 520 of the pocket 500 between the first (or outward facing) and the second (or inward facing) pocket edges 530, 540 and allowing the second (or inward facing) pocket edge 540 to move toward and contact the first (or inward facing) pocket edge 530 to close the pocket entrance opening 510 into the pocket space or bag 520 of the pocket 500. In the closed position 501, at least a portion of the top surface 322 of the bottom layer 321 proximate the second (or inward facing) pocket edge 540 is adjacent to or in contact with the bottom surface 313 of the top layer 311 closing the pocket entrance opening 510 into the pocket space or bag 520 of the pocket 500.

Figure 5:
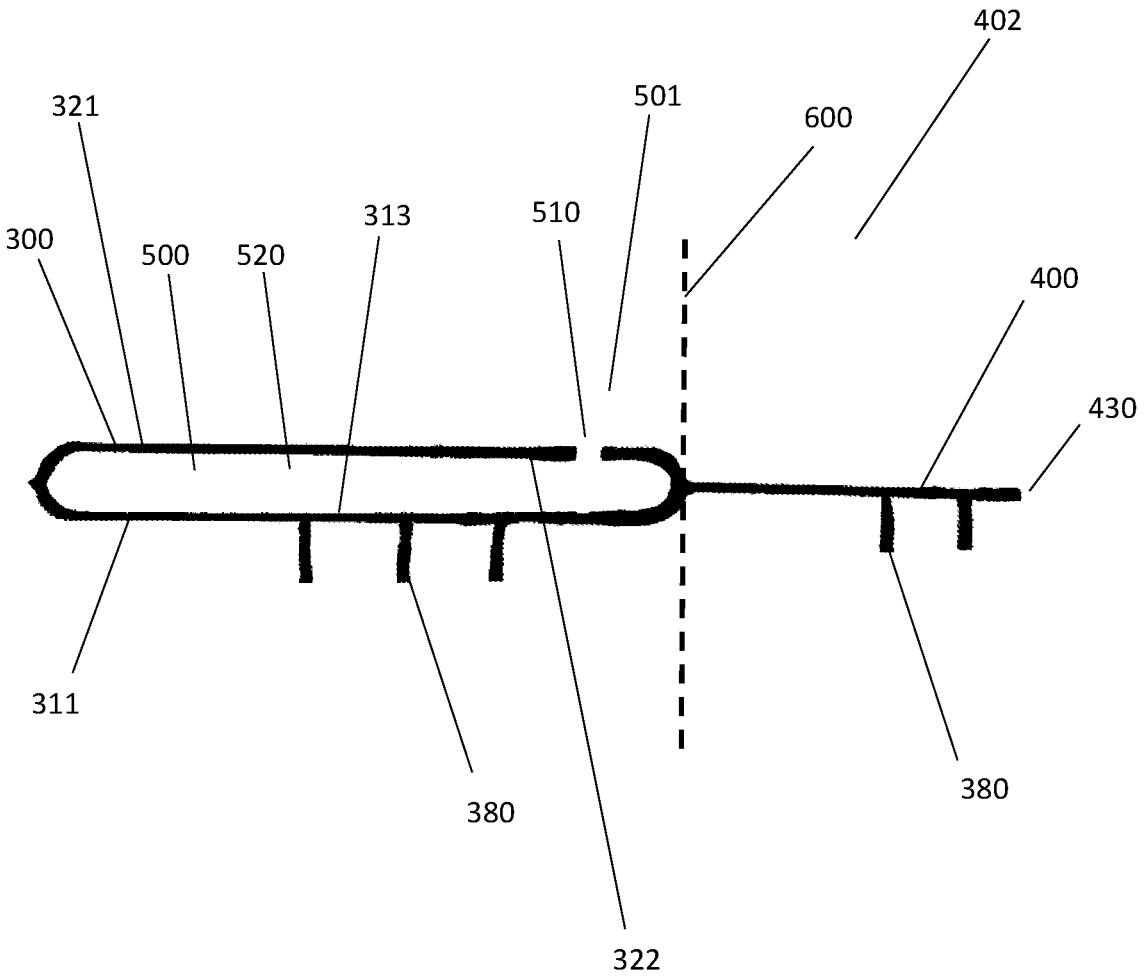
FIG. 5 is a cross-sectional view taken along line A-A in FIG. 1 illustrating the second part of the fastener of FIG. 1 with the extender thereof shown in an extended or in-use position.
Figure 6:
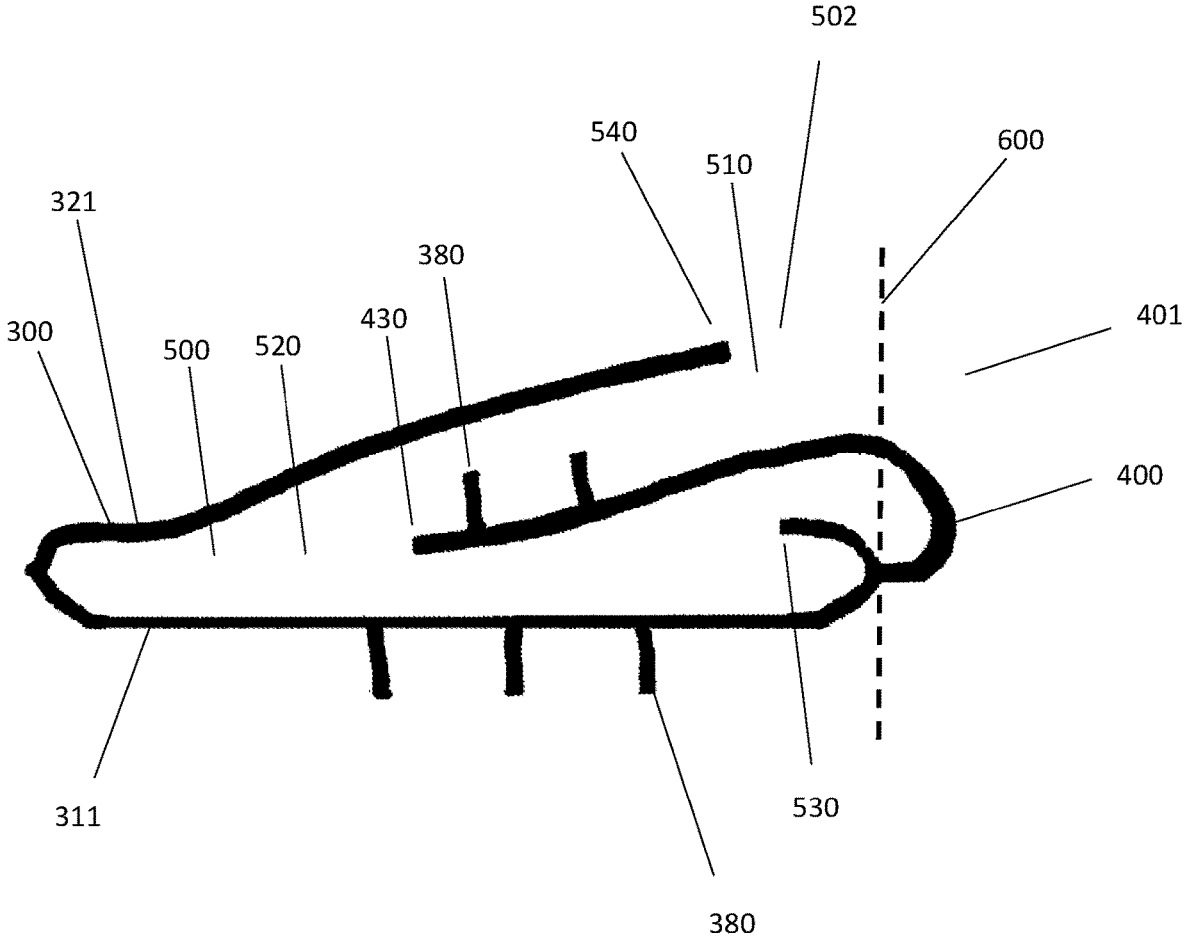
FIG. 6 is a cross-sectional view illustrating the second part of the fastener of FIG. 1 with the extender thereof shown in a retracted or stored position.

FIG. 5 is a cross-sectional view taken along line A-A in FIG. 1 illustrating the second part 300 of the fastener 100 of FIG. 1 with the extender 400 thereof shown in an extended or in-use position 402. And, FIG. 6 is a cross-sectional view illustrating the second part 300 of the fastener 100 of FIG. 1 with the extender 400 thereof shown in a retracted or stored position 401.

The extender 400 is moveable from an extended or in-use position 402 to a retracted or stored position 401 by folding the second part 300 proximate the example fold line (or dividing line, line of separation, demarcation line) 600 between the second part 300 and the extender 400 inwardly toward the pocket entrance opening 510, moving the pocket entrance opening 510 to the opened position 502, and inserting the first or right edge 430 of the extender 400 through the pocket entrance opening 510 and into the pocket space 520 of the pocket 500. Note that the fold line 600 indicates example locations where the second part 300 and/or extender 400 may be folded. In some embodiments, along the fold line 600, a crease, groove, or folding crease 602 may be formed by embossing, for example, to facilitate easier folding.

The extender 400 is moveable from the retracted or stored positions 401 to the extended or in-use position 402 by removing the first or right edge 430 of the extender 400 from the pocket space 520 of the pocket 500 through the pocket entrance opening 510, moving the pocket entrance opening 510 to the closed position 501, and unfolding the second portion 300 proximate the fold line 600 outwardly away from the pocket entrance opening 510.

In one embodiment, the extender 400 is an integral continuation of the second part 300. In other words, the extender 400 and the second part 300 are one piece with the extender 400 forming one end (e.g., the right end) of the second part 300. In this embodiment, the extender 400 is configured to be stored in the pocket 500 by folding the second part 300 proximate the fold line 600 so that the extender 400 may be stored in the pocket space 520 when not in use. In addition, the extender 400 is configured to be pulled out of the pocket space 520 and unfolded when in use.

In another embodiment, the extender 400 and the second part 300 are separate pieces. In this embodiment, the extender 400 is attached (e.g., connected, sewn, glued, bonded, coupled, joined, etc.) to the end or edge 330 of the second part 300.

In a further embodiment, the extender 400 and the second part 300 are again separate pieces. In this embodiment, at least one male element 280 is attached proximate an end or edge 440 of the extender 400, the male element 280 being configured to engage with a female element 380 of the second part 300. The extender 400 may be separated from the second part 300 before being stored in the pocket space 520 of the pocket 500.

In a yet a further embodiment, the bottom layer 321 of the second part 300 of the fastener 100 may be omitted. In this embodiment, the pocket 500 is formed by attaching the second (or left), top, and bottom edges 315, 316, 317 of the top layer 311 of the second part 300 directly to a surface 721 of a garment 700 (e.g., to the outer surface 721 of the wing 720 of the bra 700 as shown in FIGS. 7-8) leaving the first (or right) edge 314 unattached. In particular, the pocket entrance opening 510 is formed by the unattached first (or right) edge 314 of the top layer 311 and the outer surface 721 of the wing 720 of the bra 700. And, the pocket space 520 is formed between the bottom surface 313 of the top layer 311 and the outer surface 721 of the wing 720 of the bra 700.

FIG. 7 is front view illustrating the fastener 100 of FIG. 1 attached to portions 710, 720 of an example garment 700 and showing the fastener 100 and garment 700 in an unfastened position 701. And, FIG. 8 is front view illustrating the fastener 100 of FIG. 1 attached to the portions 710, 720 of the example garment 700 and showing the fastener 100 and garment 700 in a fastened position 702. Note that in FIGS. 7-8 the extender 400 is shown in the extended position 402.

In one embodiment, the first part 200 of the fastener 100 may be attached to a first or right portion 710 of the back of a garment 700 and the second part 300 may be attached to a second or the left portion 720 of the back of the garment 700. In another embodiment, the fastener 100 is reversible, that is, the first part 200 of the fastener 100 may be attached to the left portion 720 of the garment 700 and the second part 300 may be attached to the right portion 710 of the garment 700. In further embodiments, the first and second parts 200, 300 of the fastener 100 may be arranged vertically or approximately vertically or at an inclined angle.

The fastener 100 may be used to fasten 702 the garment 700 (i.e., fasten or attach the first portion 710 to the second portion 720) about a wearer by the wearer moving the first and second portions 710, 720 of the garment 700 into proximity and then engaging one or more male elements 280 of the first part 200 (e.g., attached to the first portion 710) of the fastener 100 with one or more female elements 380 of the second part 300 (e.g., attached to the second portion 720) or of the extender 400 of the fastener 100. The wearer may unfasten 701 the garment 700 by disengaging the one or more male elements 280 of the first part 200 of the fastener 100 from the one or more female elements 380 of the second part 300 or of the extender 400 of the fastener 100 and moving the first and second portions 710, 720 of the garment 700 apart.

In some embodiments, the male and female elements 280, 380 may be other than hook and eye elements. For example, the male and female elements 280, 380 may be respective hook (rough side) and loop (soft side) Velcro™ strips, respective buttons and button holes, respective stud and socket snaps, etc.

The fastener 100 may be used to fasten together portions of garments such as bras, pants, skirts, coats, jackets, etc. In addition, the fastener 100 may be used to fasten together portions of items other than garments (e.g., furniture covers, tents, etc.).

In operation, the fastener 100 may be used to fasten first and second portions 710, 720 of a garment 700 (e.g., a bra, other garment, or other item) together by first attaching the first part 200 of the fastener 100 to the first portion 710 of the garment 700 and the second part 300 of the fastener 100 to the second portion 720 of the garment 700. Next, having put on the garment 700, a wearer may move the first and second portions 710, 720 of the garment 700 into proximity and then engage one or more male elements 280 of the first part 200 (e.g., attached to the first portion 710) of the fastener 100 with one or more female elements 380 of the second part 300 (e.g., attached to the second portion 720) of the fastener 100 to thereby fasten 702 the garment 700 about the wearer's body. If the wearer needs to expand the garment 100 to improve fit, the wearer may unfasten 701 the garment 100, remove the extender 400 from its pocket 500 in the second part 300 of the fastener 100, unfold the extender 400 to its extended position 402, move the first and second portions 710, 720 of the garment 700 into proximity, and engage one or more male elements 280 of the first part 200 of the fastener 100 with one or more female elements 380 of the extender 400 (e.g., attached to the second portion 720 via the second part 300) to thereby refasten 702 the now expanded garment 700 about the wearer's body.

Advantageously, the fastener 100 may used to improve the fit of a garment 100 when desired by a wearer without the wearer having to worry about misplacing or losing separate expander devices.

While particular elements, embodiments and applications of the present application have been shown and described, it will be understood, that the scope of the application is not limited thereto, since modifications can be made by those skilled in the art without departing from the scope of the present application, particularly in light of the foregoing teachings. Thus, for example, in any method or process disclosed herein, the acts or operations making up the method/process may be performed in any suitable sequence and are not necessarily limited to any particular disclosed sequence. Elements and components can be configured or arranged differently, combined, and/or eliminated in various embodiments. The various features and processes described above may be used independently of one another, or may be combined in various ways.

All possible combinations and subcombinations are intended to fall within the scope of this application. Reference throughout this disclosure to "some embodiments," "an embodiment," or the like, means that a particular feature, structure, step, process, or characteristic described in connection with the embodiment is included in at least one embodiment. Thus, appearances of the phrases "in some embodiments," "in an embodiment," or the like, throughout this application are not necessarily all referring to the same embodiment and may refer to one or more of the same or different embodiments. Indeed, the novel methods and systems described herein may be embodied in a variety of other forms; furthermore, various omissions, additions, substitutions, equivalents, rearrangements, and changes in the form of the embodiments described herein may be made without departing from the spirit of the application.

Various aspects and advantages of the embodiments have been described where appropriate. It is to be understood that not necessarily all such aspects or advantages may be achieved in accordance with any particular embodiment. Thus, for example, it should be recognized that the various embodiments may be carried out in a manner that achieves or optimizes one advantage or group of advantages as taught herein without necessarily achieving other aspects or advantages as may be taught or suggested herein.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more embodiments or that one or more embodiments necessarily include logic for deciding, with or without operator input or prompting, whether these features, elements and/or steps are included or are to be performed in any particular embodiment. No single feature or group of features is required for or indispensable to any particular embodiment. The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list.

Any example calculations, simulations, results, graphs, values, and parameters of the embodiments described herein are intended to illustrate and not to limit the disclosed embodiments. Other embodiments can be configured and/or operated differently than the illustrative examples described herein.

What is claimed is:

1. A fastener, comprising:

a first part comprising a body and a male fastener element attached to the body;

a second part comprising an elongated body having a top layer, a bottom layer, and a plurality of female fastener elements attached to a top surface of the top layer of the body and arranged at predetermined distances along a length of the top layer, each female fastener element configured to be selectively engageable with the male fastener element of the first part, the bottom layer having a slit formed therein extending transversely across the bottom layer forming a pocket entrance opening into a pocket space of a pocket formed between the top layer and the bottom layer, the pocket entrance opening having a pocket edge that is movable from a closed position wherein the pocket entrance opening is closed to an opened position wherein the pocket entrance opening is opened; and, an extender comprising an elongated body, the elongated body of the extender being an integral continuation of the elongated body of the second part, and a fold line formed transversely across the elongated body between the second part and the extender, the extender having a plurality of female fastener elements attached to a top surface of the elongated body of the extender and arranged at predetermined distances along a length of the elongated body, wherein the extender extends from an end of the elongated body of the second part, the extender being movable from an extended or in-use position to a retracted or stored position by folding the extender along the fold line inwardly toward the pocket entrance opening and inserting the extender through the pocket entrance opening and into the pocket space.

2. The fastener of claim 1, further comprising a crease or groove formed along the fold line.

3. The fastener of claim 1, wherein the extender is stitched or bonded to the end of the elongated body of the second part.

4. The fastener of claim 1, wherein the bottom layer of the second part includes a cushioning material or a cushioning layer to provide cushioning for the female elements of the extender when the extender is in the retracted or stored position.

5. The fastener of claim 1, wherein the male fastener element is a hook and each female fastener element of the second part and of the extender is an eye.

6. The fastener of claim 1, wherein the male fastener element is a plurality of male fastener elements and the plurality of female fastener elements of the second part and of the extender are arranged in one or more respective rows and columns.

7. The fastener of claim 1, wherein the fastener is attachable between first and second portions of a garment to fasten the first and second portions together.

8. The fastener of claim 7, wherein the garment is a bra.

9. The fastener of claim 7, wherein the garment is a maternity garment.

* * * * *